US005285645A

United States Patent [19]

Yamada et al.

[11] Patent Number: 5,285,645

[45] Date of Patent: Feb. 15, 1994

[54] REGENERATIVE TYPE AIR CONDITIONING EQUIPMENT

[75] Inventors: Akira Yamada, Hitachi; Yasuo Koseki, Hitachiota; Risuke Onoda, Ibaraki; Fumiaki Yatsuboshi, Sakai; Hirokuni Mizuno, Ibaraki, all of Japan

[73] Assignees: Hitachi, Ltd, Tokyo; The Kansai Electric Power Co., Inc., Osaka, both of Japan

[21] Appl. No.: 834,781

[22] Filed: Feb. 13, 1992

[30] Foreign Application Priority Data

Feb. 13, 1991 [JP] Japan ..... 3-20009

[51] Int. Cl.[5] ..... F25D 17/06

[52] U.S. Cl. ..... 62/91; 62/333; 62/467

[58] Field of Search ..... 62/91, 332, 333, 467

[56] References Cited

U.S. PATENT DOCUMENTS

| | | | |
|---|---|---|---|
| 3,675,441 | 7/1972 | Perez | 62/333 |
| 3,881,323 | 5/1975 | Porter | 62/333 |
| 4,334,412 | 6/1982 | Wildfeuer | 62/333 |
| 4,375,468 | 2/1983 | Takeshita et al. | 62/333 |
| 4,380,910 | 4/1983 | Hood et al. | 62/91 |
| 4,448,040 | 5/1984 | Kunugi | 62/332 |
| 4,819,445 | 4/1989 | Scherer | 62/332 |
| 4,986,079 | 1/1991 | Koseki et al. | 62/59 |

FOREIGN PATENT DOCUMENTS 62-218773 9/1987 Japan .

*Primary Examiner*—Ronald C. Capossela

*Attorney, Agent, or Firm*—Antonelli, Terry, Stout & Kraus

[57] ABSTRACT

A regenerative type air conditioning equipment in which the available concentration range of a heat accumulating liquid is widened, and the quantity of the heat accumulating liquid to be stored is decreased, so that the size of the equipment is reduced, with the conditioning equipment comprises a concentration difference regeneration device which, at least, cools a medium fed to an air conditioner, using a condensate liquid and a concentrated liquid produced by vaporizing the heat accumulating liquid, and a heat pump device which cools a coolant due to adiabatic expansion. The concentration difference regeneration device includes a container with a chamber for storing the condensate liquid, a spray nozzle which sprays the condensate liquid into the condensate liquid chamber, and an evaporator which vaporizes the sprayed condensate liquid under a low pressure. The heat pump device includes a heat exchanger which performs the heat exchange between the coolant and the medium to pass through the air conditioner, and an air cooling mode medium line in which the medium having passed through the air conditioner is circulated in the order of the evaporator, heat exchanger and air conditioner.

13 Claims, 6 Drawing Sheets

| | EVAPORATOR | | ABSORBER | |
|---|---|---|---|---|
| | INLET | OUTLET | INLET | OUTLET |
| INSIDE TEMPERATURE OF HEAT TRANSMISSION PIPE(°c) | 12 | 10 | 32 | 37 |
| OUTSIDE TEMPERATURE OF HEAT TRANSMISSION PIPE(°c) | 7 | | 40 | |

FIG. 6

| | EVAPORATOR | | ABSORBER | |
|---|---|---|---|---|
| | INLET | OUTLET | INLET | OUTLET |
| INSIDE TEMPERATURE OF HEAT TRANSMISSION PIPE (°c) | 12 | 7 | 32 | 37 |
| OUTSIDE TEMPERATURE OF HEAT TRASMISSION PIPE (°c) | 4 | | 40 | |

REGENERATIVE TYPE AIR CONDITIONING EQUIPMENT

BACKGROUND OF THE INVENTION

1. Field of the Invention

The present invention relates to an air conditioning equipment and a regenerative type air conditioning method wherein, for leveling electric power loads in the daytime and the nighttime, wherein, for example, heat is accumulated with night power so as to perform air conditioning and hot water supply in the daytime.

2. Description of the Related Art

For stabilizing the activity rate of a power plant, it has been desired to level day and night power loads. Especially in recent years when the day power load in an air cooling system in summer has become very heavy and when the capability of a power supply side has approached its limit, techniques for leveling the day and night power loads have been sought. In this regard, regenerative type air conditioning equipment has been proposed electric power generated in the nighttime is stored so as to derive it as energy for the air cooling in the daytime.

Regenerative type air conditioning equipment of the aforementioned type is proposed in, for example, Japanese Patent Application Laid-Open No. 218773, 1987, wherein adopts a concentration difference regeneration method is employed, with the equipment including a heat pump device having a compressor for adiabatically compressing a coolant, and a concentration difference regeneration device for performing air cooling and heating by a concentrated heat accumulating liquid and a condensate liquid that are produced by vaporizing the heat accumulating liquid. The concentration difference regeneration device includes a container provided with a chamber for reserving the concentrated heat accumulating liquid, and a chamber for storing the condensate liquid. The concentrated heat accumulating liquid chamber of the container is furnished with a concentrated heat accumulating liquid heat exchanger for effecting the heat exchange between the coolant adiabatically compressed and the concentrated heat accumulating liquid, and a spray nozzle for sprinkling the concentrated heat accumulating liquid into this concentrated heat accumulating liquid chamber, while the condensate liquid chamber is furnished with a condensate liquid heat exchanger for effecting the heat exchange between the coolant adiabatically compressed and the condensate liquid, and a spray nozzle for sprinkling the condensate liquid into this condensate liquid chamber.

With the regenerative type air conditioning equipment, in a heat accumulating mode, the coolant whose temperature has been raised by the adiabatic compression is passed through the concentrated heat accumulating liquid heat exchanger, to heat and vaporize the heat accumulating liquid. The remaining liquid is stored in the concentrated heat accumulating liquid chamber as the concentrated heat accumulating liquid. On the other hand, the vapor is introduced into the condensate liquid chamber and is condensed, whereupon the resulting condensate is stored in this condensate liquid chamber. In an air cooling or heating mode, the condensate liquid and the concentrated heat accumulating liquid are respectively sprayed by the corresponding spray nozzles, the sprayed condensate liquid is vaporized under a low pressure, and the sprayed concentrated heat accumulating liquid is caused to absorb this condensate liquid.

Herein, in the air cooling mode, the latent heat of vaporization of the condensate is taken away from a medium having passed through an air conditioner, thereby cooling the medium, and the cooled medium is immediately fed to the air conditioner. In the heating mode, the medium passing through the air conditioner is heated by the heat of absorption developing from the concentrated heat accumulating liquid.

Additionally, the heat accumulating liquids of high and low concentrations are reserved in an identical reservoir. Whenever the heat accumulating liquid is to be drawn out of the reservoir, it is drawn out from the lower part of this reservoir, and whenever it is to be returned into the reservoir, it is returned thereinto from the upper part of the container.

In recent years, a large number of such regenerative type air conditioning equipment has been found in urban areas. In this regard, reduction in the size of the equipment is eagerly requested because of the influences of a sudden rise in the price of land, and so on.

Nevertheless, the regenerative type air conditioning equipment in the prior art cannot meet this request. More specifically, in the air cooling mode, the medium is cooled to a desired temperature by taking the latent heat of vaporization of the condensate liquid from the medium of the air conditioner, and the cooled medium is directly fed to the air conditioner. Therefore, the concentrated heat accumulating liquid which absorbs the vapor of the condensate liquid so as to vaporize this condensate liquid at a low temperature cannot be used until it turns into the heat accumulating liquid of low concentration. Accordingly, a large sized liquid reservoir is required.

Also, in the heating mode, the condensate liquid is vaporized merely under the low pressure condition without being heated, so that a low internal pressure of the container needs to be maintained. Therefore, the concentrated heat accumulating liquid cannot be used until there is a low concentration, and liquid reservoir is large in size.

Generally, a liquid of high concentration is higher in density than a liquid of low concentration, for this reason, when these liquids are received in an identical container, the high concentration liquid precipitates downwardly in the container. With the regenerative type air conditioning equipment in the prior art, even in the heat accumulating mode, the heat accumulating liquid is drawn out of the lower part of the reservoir, and the concentrated heat accumulating liquid is put into the reservoir from the upper part thereof. Consequently, the heat accumulating liquid which has been concentrated liquid into the high concentration precipitates downwardly, and it mixes with the heat accumulating liquid of the low concentration which is not concentrated, so that the heat accumulating liquid cannot be held at the high concentration. Therefore, the heat accumulating liquid having reached a somewhat high level needs to be reserved in a comparatively large amount, and the reservoir of the heat accumulating liquid necessarily becomes large sized.

In this manner, the regenerative type air conditioning equipment in the prior art has a problem in that, since the available concentration range of the heat accumulating liquid is narrow, the quantity of this heat accumulating liquid which needs to be reserved is large, thereby increasing the size of the equipment.

Moreover, the regenerative type air conditioning equipment in the prior art has a problem in that, since a concentrating operation and a diluting operation at different temperature levels are carried out in the identical container, the start stage of the concentrating operation requires surplus heat until the container is heated, whereas the start stage of the diluting operation is incapable of deriving a predetermined temperature for the air cooling until the container is cooled.

SUMMARY OF THE INVENTION

It is an object of the present invention to widen the available concentration range of a heat accumulating liquid, thereby decreasing the necessary quantity of the heat accumulating liquid which must be stored and thus reducing the size of an air conditioning equipment.

Another object of the present invention is to dispense with surplus heat having been required at the start of a concentrating operation, and to shorten the starting time period of a diluting operation.

Accordingly to the present invention, a regenerative type air conditioning equipment is provided wherein a concentrated heat accumulating liquid can be used until a concentration of the heat accumulating liquid becomes comparatively low, so that the size of the equipment can be reduced. The regenerative type air conditioning equipment includes a heat pump device which develops a low temperature through adiabatic expansion of a coolant, and a concentration difference regeneration device which, at least, cools a medium to be fed to an air conditioner, using a condensate liquid and a concentrated heat accumulating liquid that are produced by vaporizing the heat accumulating liquid. The concentration difference regeneration device includes an evaporator which vaporizes the condensate liquid under a low pressure, thereby taking heat away from the medium sent from the air conditioner and cooling the medium. The heat pump device includes a heat exchanger which subjects the medium cooled by the evaporator, to a heat exchange with the coolant, thereby cooling the medium even more, and which feeds the cooled medium to the air conditioner.

According to further features of the present invention, a regenerative type air conditioning equipment is provided wherein a concentrated heat accumulating liquid can be used until a concentration of the heat accumulating liquid becomes comparatively low one, so that the size of the equipment can be reduced. The regenerative type air conditioning equipment includes a heat pump device which develops a high temperature through adiabatic compression of a coolant, and a concentration difference regeneration device which performs at least heating and/or hot water supply. This is achieved by using a concentrated heat accumulating liquid and a condensate liquid that are produced by vaporizing the heat accumulating liquid. This regenerating type air conditioning equipment is characterized by the fact that the concentration difference regeneration device includes an evaporator directly or indirectly removes heat from the coolant which has had its temperature raised by the heat pump device, thereby vaporizing the condensate liquid. The equipment further comprises a spray nozzle, for spraying the vaporized condensate liquid with the concentrated heat accumulating liquid, and an absorber subjecting the concentrated heat accumulating liquid having generated heat through the absorption of the vaporized condensate liquid, to a heat exchange with a medium passing through an air conditioner and/or a hot water supplier, thereby heating the medium.

In a regenerative type air conditioning equipment a concentrated heat accumulating liquid and an unconcentrated heat accumulating liquid are difficult to mix, and the concentrated heat accumulating liquid of high concentration can be produced, so that the size of the equipment can be reduced. For this purpose, according to the invention, the regenerative type air conditioning equipment comprises an upper nozzle and a lower nozzle which are respectively provided at an upper part and a lower part of a reservoir for the heat accumulating liquid, and three-way valves which are respectively capable of switching connection tips of the upper and lower nozzle between a heat accumulating liquid return line for returning the heat accumulating liquid into the heat accumulating liquid reservoir and a heat accumulating liquid delivery line for delivering the heat accumulating liquid out of the heat accumulating liquid reservoir.

In accordance with still further features of the present invention, a regenerative type air conditioning equipment is proposed which can dispense with surplus heat required at the start of a concentrating operation, thereby enabling a shortening of the starting time period of a diluting operation. The regenerative type air conditioning equipment characterized by the fact that a concentrating container in which a heat accumulating liquid is vaporized so as to be concentrated, and a diluting container in which a condensate liquid is absorbed by a concentrated heat accumulating liquid so as to dilute the concentrated heat accumulating liquid, with the concentrating container and the diluting container being separate from each other.

In a heat accumulating operation, the heat pump device is driven by electric power in the nighttime, and the heat accumulating liquid is vaporized to produce the condensate liquid and the concentrated heat accumulating liquid, whereby heat is accumulated. On this occasion, the three-way valve connected to the upper nozzle of the heat accumulating liquid reservoir is preset to the side of the heat accumulating liquid delivery line, while the three-way valve, connected to the lower nozzle is preset to the side of the heat accumulating liquid return line. When the three-way valves are set in this manner, the unconcentrated heat accumulating liquid of low concentration is drawn out through the upper nozzle, and the concentrated heat accumulating liquid of high concentration is fed into the heat accumulating liquid reservoir through the lower nozzle.

Thus, the heat accumulating liquid having a high concentration and exhibiting a high density is fed into the heat accumulating liquid reservoir from the lower part thereof. Consequently, this heat accumulating liquid is less liable to mix with the heat accumulating liquid of a low concentration, and the heat accumulating liquid of a high concentration can be produced, so that reduction in the size of the heat accumulating liquid reservoir can be achieved.

In an air cooling operation, the condensate liquid produced by the heat accumulating operation is vaporized under low pressure, and the medium sent from the air conditioner into the evaporator is deprived of its heat, thereby cooling the medium. Subsequently, this medium is passed through the heat exchanger of the heat pump device and is subjected to the heat exchange with the coolant circulating through the heat pump device, thereby being further cooled to a desired temperature.

When, in this manner, the medium sent from the air conditioner need not be cooled down to the desired temperature by the concentration difference regeneration device, the vaporization temperature of the condensate liquid can be set at a comparatively high point, and hence, the internal pressure of the container can also be set at a comparatively high value. In this regard, the concentrated heat accumulating liquid, which absorbs the vapor of the condensate liquid in order to maintain the vaporizing environment of this condensate at a low pressure, exhibits a lower water vapor pressure at a higher concentration similar to ordinary aqueous solutions.

Accordingly, the pressure inside the container can be set at the comparatively high pressure, and the concentrated heat accumulating liquid of low concentration having a high water vapor pressure becomes usable, so that reduction in the size of the heat accumulating liquid reservoir can be achieved.

In a heating operation or hot water supply operation, the condensate liquid is directly or indirectly heated for vaporization by the use of the coolant whose temperature has been raised by the heat pump device, and the vapor of the condensate liquid is sprayed with the concentrated heat accumulating liquid so as to be absorbed by this liquid. On this occasion, the concentrated heat accumulating liquid generates heat, with which the medium passing through the air conditioner or the hot water supplier is heated.

Since the condensate liquid is heated and vaporized in this manner, it is vaporized even when the internal pressure of the container is comparatively high.

For the same reason as in the air cooling operation, accordingly, the concentrated heat accumulating liquid of comparatively low concentration can also be used in the heating operation, so that a reduction in the size of the heat accumulating liquid reservoir can be achieved.

In the heating or hot water supply operation and in the air cooling operation, the three-way valve connected to the upper nozzle of the heat accumulating liquid reservoir is set to the side of the heat accumulating liquid return line, while the three-way valve connected to the lower nozzle is set to the side of the heat accumulating liquid delivery line. Thus, the concentrated heat accumulating liquid of high concentration is fed into the lower part of the container.

With the equipment which comprises the concentrating container and the diluting container as the members separate from each other, when the heat accumulating operation shifts to the air cooling operation or to the heating operation, it is possible to relieve heat loss due to the sensible heat changes of the constituents of each of the concentrating and diluting containers attributed to the unequal temperature levels of the individual operations, so that the starting time period can be reduced.

BRIEF DESCRIPTION OF THE DRAWINGS

FIG. 4 is a graphical illustration of water vapor pressure characteristics of water and an aqueous solution of LiBr;

FIGS. 5 and 6 are tables each indicating the temperature conditions of an evaporator and an absorber.

DETAILED DESCTIPTION OF THE PREFERRED EMOBODIMENTS

Figure 1:
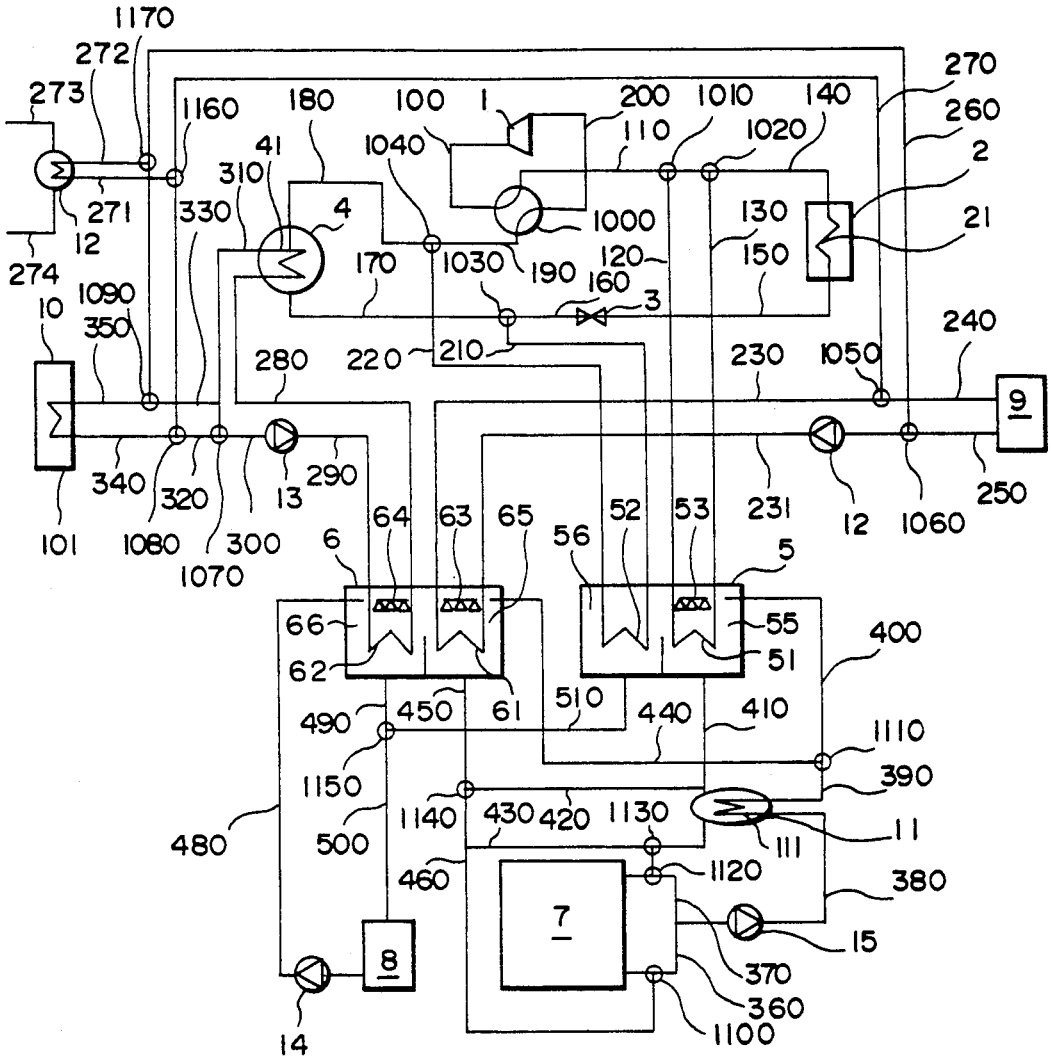
FIG. 1 is a schematic of the general system of a regenerative type air conditioning equipment according to an embodiment of the present invention.

As shown in FIG. 1, a compression type heat pump device is constructed having a compressor 1 which compresses a coolant, a first heat exchanger 4 for performing the heat exchanges between the coolant and the medium etc. of an air conditioner 10 etc., an expansion valve 3 for adiabatically expanding the coolant, a second heat exchanger 2 for performing the heat exchange between air and the coolant, a four-way changeover valve 1000, and piping 100 110 140, . . . , and 200 which connects the above components.

On the other hand, a concentration difference regeneration device is constructed having a concentrating container 5 which concentrates a heat accumulating liquid, a diluting container 6 which dilutes the heat accumulating liquid, a reservoir 7 for the heat accumulating liquid, a reservoir 8 for a condensate liquid, a heat recoverer 11, a pump 15 by which the heat accumulating liquid in the heat accumulating liquid reservoir 7 is fed into the heat recoverer 11, a pump 14 by which the condensate liquid in the condensate liquid reservoir 8 is fed into the diluting container 6 and piping at numerals 360 370, . . . , and 510 which connects the above components.

The concentrating container 5 and the diluting container 6 include chambers 55 and 65 for temporarily storing the concentrated heat accumulating liquid, and chambers 56 and 66 for storing the condensate liquid, respectively. The chambers 55 and 56, and 65 and 66 are held in communication with each other so that a vapor can move therebetween. The communicating parts of the chambers are provided with means, for example, an eliminator (not shown) for removing mist (minute droplets) entrained by the moving vapor. Further, the concentrating container 5 is internally furnished with a spray nozzle 53 which sprays the heat accumulating liquid into the concentrated heat accumulating liquid chamber 55, an evaporator 51 which vaporizes the sprayed heat accumulating liquid, and a condenser 52 which condenses the vapor in the condensate liquid chamber 66. On the other hand, the diluting container 6 is internally furnished with a spray nozzle 63 which sprays the concentrated heat accumulating liquid into the concentrated heat accumulating liquid chamber 65, an absorber 61 which cools the concentrated heat accumulating liquid sprayed, a spray nozzle 64 which sprays the condensate liquid into the condensate liquid chamber 66, and an evaporator 62 which vaporizes the sprayed condensate liquid.

Three-way valves 1120 and 1100 are respectively connected to the tips of the upper nozzle and lower nozzle of the heat accumulating liquid reservoir 7. Further, the heat accumulating liquid return lines 430 and 460 and the heat accumulating liquid delivery lines 360 and 370 are respectively connected to the three-way valves 1120 and 1100.

Incidentally, the aqueous solution of any salt is usually employed as the heat accumulating liquid. Accordingly, the condensate liquid becomes water.

Other constituent devices are a water cooling tower 9, and a heat exchanger for hot water supply 12.

In the illustrated embodiment, it is assumed that the gas "R-22" is used as the coolant which is circulated through the heat pump device, water as the medium which is passed through the water cooling tower 9, room air conditioner 10, heat exchanger for hot water supply 12, etc., and the aqueous solution of LiBr as the heat accumulating liquid.

Figure 2:
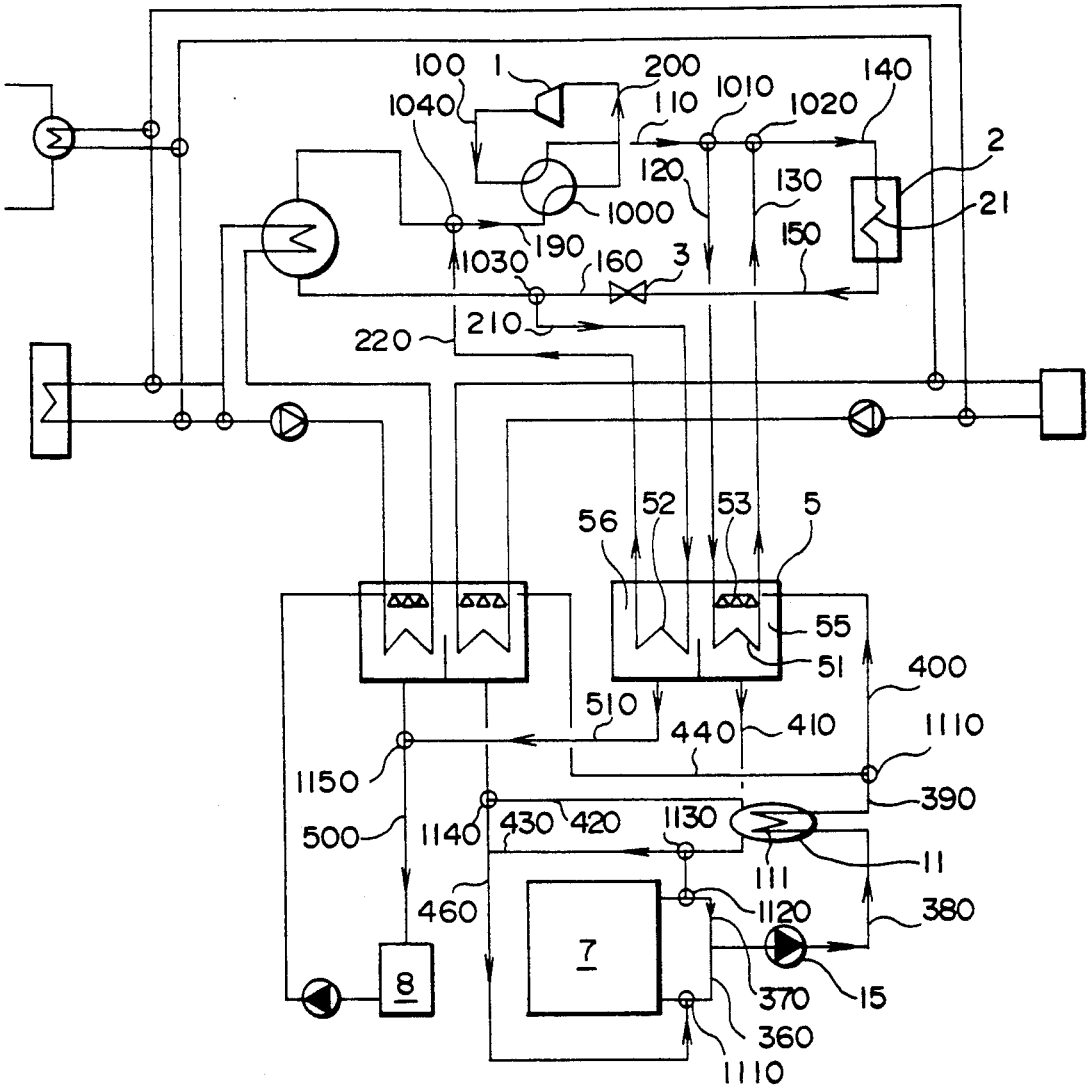
FIG. 2 is a schematic view of illustrating a heat accumulating operation of the regenerative type air conditioning equipment in the embodiment.

In FIG. 2, in order to facilitate understanding the heat accumulating operation, numerals are affixed only to parts relevant to the heat accumulating operation in the regenerative type air conditioning equipment illustrated in FIG. 1.

The R-22 gas whose temperature and pressure have risen through compression by the compressor 1, flows through the piping 100, four-way changeover valve 1000 and piping 110 and then flows to piping 120 via a three-way valve 1010. Noncondensible gases, such as air, contained in the concentrating container 5 of the concentration difference regeneration device are excluded by bleeding. Under this state, the R-22 gas from the above piping 120 flows into the heat transmission pipe of the evaporator 51 disposed in the concentrating container 5. On this occasion, the heat accumulating liquid is introduced from the heat accumulating liquid reservoir 7 into the heat accumulating liquid spray nozzle 53 of the concentrating container 5 through the upper nozzle of the reservoir 7, the valve 1120, the pump 15, etc., and it is sprayed outside the heat transmission pipe of the evaporator 51. The sprayed heat accumulating liquid is subjected to a heat exchange with the R-22 gas contained in the heat transmission pipe of the evaporator 51, thereby being heated and generating water vapor. On the other hand, the R-22 gas becomes a wet gas, which is introduced into the second heat exchanger 2 via piping 130, a valve 1020 and the piping 140.

The heat transmission pipe 21 of the second heat exchanger 2 is cooled by air which is blown by a fan (not shown) or the like. The R-22 gas (in the wet state) liquefies here, and the liquid flows to the expansion valve 3 through the piping 150. The liquid from the R-22 gas is adiabatically expanded by the expansion valve 3 and is turned into a wet gas of low temperature and low pressure, which is introduced into the heat transmission pipe of the condenser 52 via the piping 160, a valve 1030 and piping 210.

Since the water vapor developed in the evaporator 51 flows outside the heat transmission pipe of the condenser 52, it exchanges heat with the R-22 gas (in the wet state) inside the heat transmission pipe of the condenser 52. Thus, the water vapor turns into condensed water, and the R-22 gas turns into a saturated gas.

The R-22 gas is introduced into the compressor 1 again via piping 220, a valve 1040, the piping 190, the four-way changeover valve 1000, and piping 200. On the other hand, the condensed water is introduced into the condensate liquid reservoir 8 via the piping 510, a valve 1150, and the piping 500.

The heat accumulating liquid concentrated by the vaporization is introduced into the heat accumulating liquid reservoir 7 via the piping 410, the heat recoverer 11, a valve 1130, the piping 430, the piping 460, and a valve 1100.

The concentrated heat accumulating liquid whose density has been increased by the concentration, is fed into the heat accumulating liquid reservoir 7 from the lower part thereof in this manner. Therefore, the concentrated heat accumulating liquid of increased density and the heat accumulating liquid which is not yet concentrated are less liable to mix, and the concentrated heat accumulating liquid of high concentration can be produced.

In the above way, the heat accumulating liquid is reserved in the concentrated state. As will be stated later, the concentrated heat accumulating liquid has an intensified water vapor absorbing property and has consequently accumulated heat.

Figure 3:
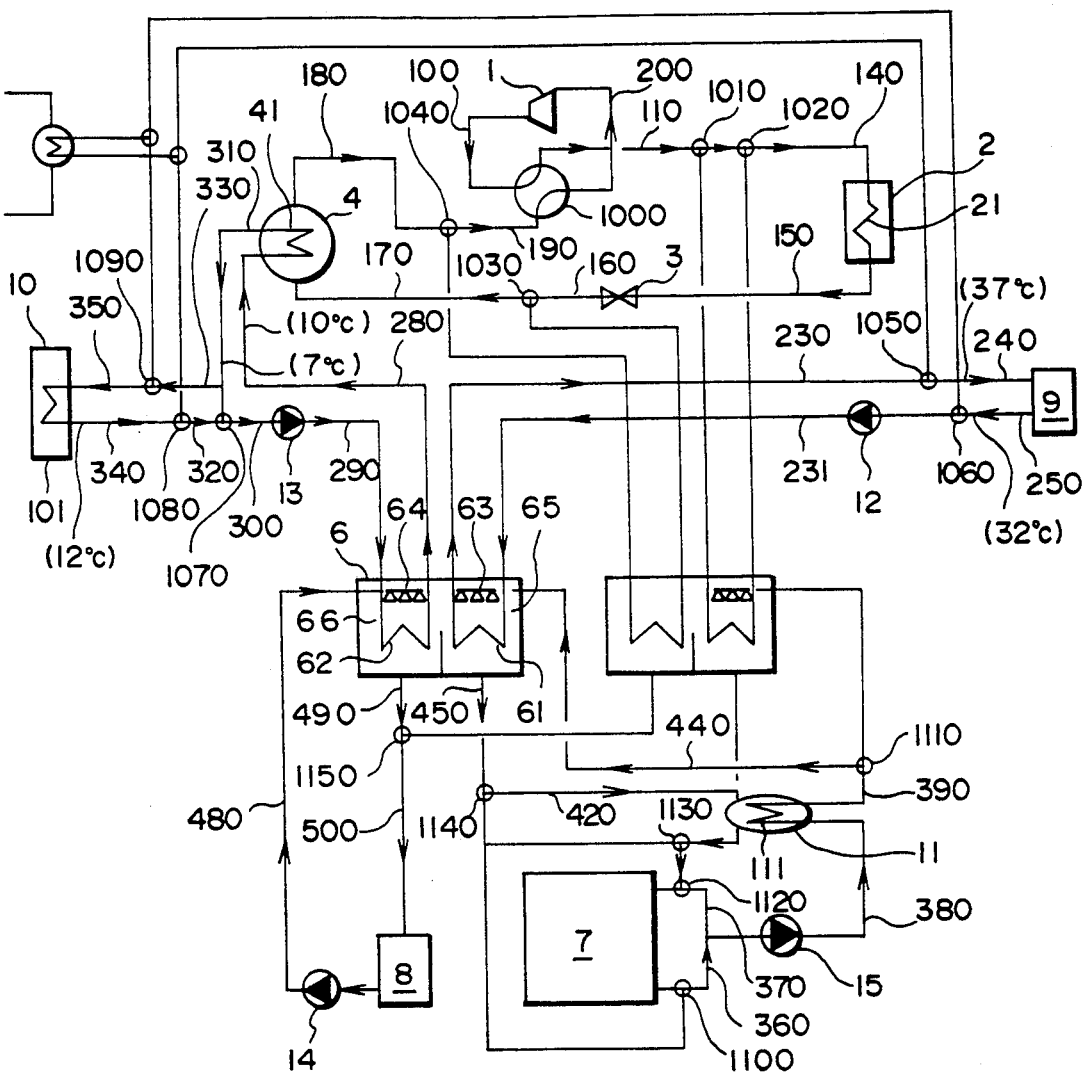
FIG. 3 is a schematic view of illustrating an air cooling operation of the regenerative type air conditioning equipment in the embodiment.

In FIG. 3, numerals are affixed only to parts relevant to this operation in the regenerative type air conditioning equipment illustrated in FIG. 1.

As shown in FIG. 3, the R-22 gas compressed by the compressor 1 in order to raise its temperature and pressure reaches the valve 1010 due to the same flow as in the heat accumulating operation stated above, and it is further introduced into the second heat exchanger 2 via the valve 1020 and the piping 140. The heat transmission pipe 21 of the second heat exchanger 2 is cooled by the air as in the foregoing description, and the R-22 gas is condensed into a saturated liquid. The liquid from the R-22 gas is thereafter passed through the expansion valve 3 via the piping 150, and it is adiabatically expanded into a wet gas of low temperature and low pressure at that time. The wet gas is introduced into the first heat exchanger 4 via the piping 160, valve 1030 and piping 170.

Cold water cooled down to approximately 10° C. by the evaporator 62 of the concentration difference regeneration device described more fully hereinbelow is introduced into the heat transmission pipe 41 of the first heat exchanger 4 via piping 280. In the first heat exchanger 4, the cold water and the R-22 gas (in the wet state) are subjected to a heat exchange. Here, the cold water is cooled from 10° C. down to 7° C. The resultant cold water is introduced into the heat transmission pipe 101 of the room air conditioner 10 via piping 310, piping 330, a valve 1090, and piping 350. On the other hand, the R-22 gas in the wet state is turned, by the heat exchange, into a saturated gas, which is introduced into the compressor 1 again via the piping 180, valve 1040, piping 190, four-way changeover valve 1000 and piping 200.

Cold water, whose temperature has been raised up to approximately 12° C. by the heat exchanger 101 of the room air conditioner 10, is introduced into the heat transmission pipe of the evaporator 62 of the diluting container 6 of the concentrated difference regeneration device via piping 340, a valve 1080, piping 320, a valve 1070, piping 300, a pump 13, and piping 290. Also, condensed water is sprayed from the condensate liquid reservoir 8 to the outer side of the evaporator 62 via the pump 14 as well as the condensate liquid spray nozzle 64. Here, the cold water sent from the room air conditioner 10 and the condensed water sprayed are subjected to a heat exchange. Then, the condensed water gasifies into a vapor, and the cold water at approximately 12° C. is cooled down to 10° C.

Cooling water at 32° C. is fed from the cooling tower 9 into the heat transmission pipe of the absorber 61 of the diluting container 6 via piping 250, a valve 1060, a pump 12, and piping 231, and the concentrated heat accumulating liquid from the bottom part of the heat accumulating liquid reservoir 7 is sprayed outside the heat transmission pipe of the absorber 61 via the valve 1100, piping 360, pump 15, concentrated heat accumulating liquid spray nozzle 63, etc. The concentrated heat accumulating liquid absorbs the vapor produced by the evaporator 62, to become of a higher temperature, and it exchanges heat with the cooling water. The cooling water has its temperature raised from 32° C. to 37° C. here, whereupon it is resent to the cooling tower 9 via piping 230, a valve 1050, and piping 240.

The reason the condensed water can vaporize at the temperature of about 10° C. outside the heat transmission pipe of the evaporator 62 is that the produced vapor is immediately absorbed by the concentrated heat accumulating liquid, thereby lowering the pressure outside the heat transmission pipe of the evaporator 62, namely, the pressure inside the diluting container 6. On this occasion, in order to maintain the internal pressure of the diluting container 6 at or below a certain pressure, it is important that the concentrated heat accumulating liquid having absorbed the vapor and generated heat is prevented from vaporizing, and that it is caused to immediately absorb the produced vapor. Meanwhile, as with ordinary aqueous solutions, the heat accumulating liquid has the property that the vapor pressure thereof becomes lower at a higher concentration. Accordingly, the concentrated heat accumulating liquid of high concentration is necessary for preventing the vaporization of the concentrated heat accumulating liquid having absorbed the vapor, under low pressure. In other words, the concentrated heat accumulating liquid of low concentration is sufficient to maintain a high pressure.

In this regard, in a case where, as in this embodiment, the cold water with its temperature raised up to 12° C. by taking heat away from a room furnished with the air conditioner 10 is first cooled to 10° C. by the diluting container 6 of the concentration difference regeneration device and is subsequently cooled to 7° C. by the first heat exchanger 4 of the compression type heat pump device, the condensate liquid can be vaporized under a higher pressure than in the case where cold water, for example, is cooled from 12° C. to 7° C. by only the concentration difference regeneration device as in the prior art. It is therefore possible to use even the concentrated heat accumulating liquid of comparatively low concentration and to decrease the quantity of the concentrated heat accumulating liquid to be reserved. As a result, the size of the heat accumulating liquid reservoir 7 can be reduced.

Figures 4, 5:
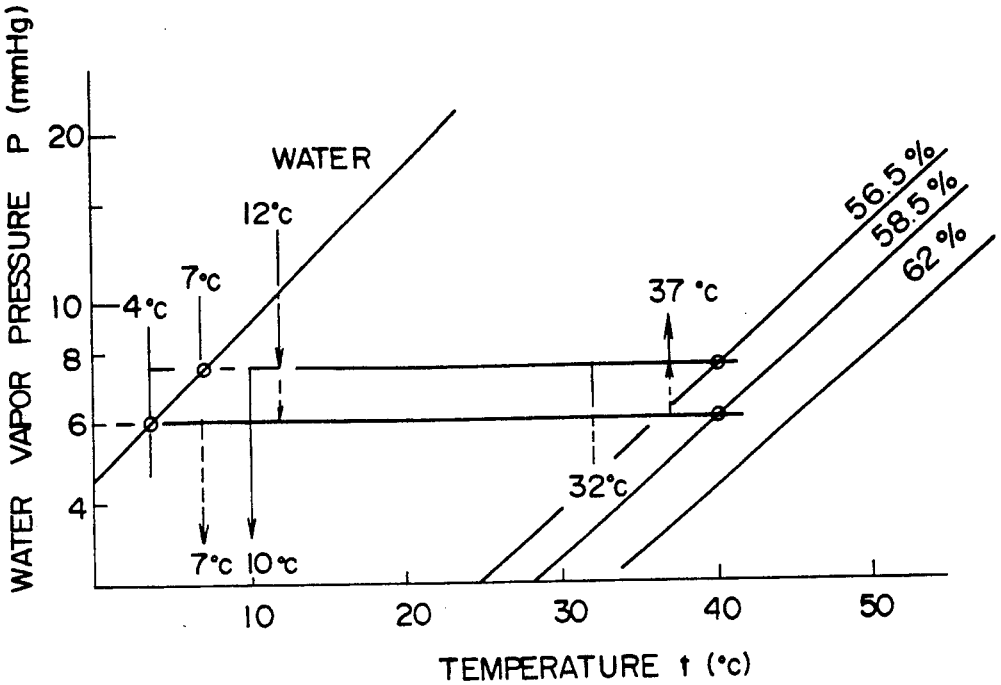

FIG. 4 shows the water vapor pressure characteristics of water and the aqueous solution of LiBr which is commonly used as the heat accumulating liquid. In FIG. 4, the abscissas represents the temperature, while the ordinate represents the water vapor pressure (hereafter, vapor pressure), and the concentration of the aqueous solution of LiBr is taken as a parameter.

Here, for the brevity of the explanation, it is assumed that, in setting the outlet temperatures of the heat transmission pipes of the evaporator 62 and the absorber 61 at desired values, temperature differences of 3° C. are required between the outlet temperatures of the heat transmission pipes and the outside temperatures thereof in both cases. Accordingly, as shown in FIG. 5, the outside temperature of the heat transmission pipe, i.e., the boiling point of the condensed water needs to be brought to 7° C. for setting the outlet temperature of the heat transmission pipe of the evaporator 62 at 10° C., while as indicated in FIG. 6, the outside temperature of the heat transmission pipe, i.e., the boiling point of the condensed water needs to be brought to 4° C. for setting the outlet temperature of the heat transmission pipe of the evaporator 62 at 7° C. Besides, when the outlet temperature of the heat transmission pipe of the absorber 61 is 37° C., the outside temperature of this heat transmission pipe, i.e., the temperature of the concentrated heat accumulating liquid needs to be brought to 40° C.

In the case where the cold water of 12° C. from the room air conditioner 10 is cooled down to 10° C. as in this embodiment, the outside pressure of the heat transmission pipe must be set at 7.5 mmHg or below for the purpose of maintaining the boiling point of the condensed water at or below 7° C., as apparent from FIG. 4. In order to prevent the concentrated heat accumulating liquid from vaporizing when the outside temperature of the heat transmission pipe is 40° C. under the aforementioned pressure, the concentration of this liquid may be 56.5% or above.

On the other hand, in the case where the cold water of 12° C. from the room air conditioner 10 is cooled down to 7° C. in a single step, the outside pressure of the heat transmission pipe must be at 6.0 mmHg or below for the purpose of maintaining the boiling point of the condensed water at or below 4° C. Herein, in order to prevent the concentrated heat accumulating liquid from vaporizing when the outside temperature of the heat transmission pipe is 40° C. under the aforementioned pressure, the concentration of this liquid needs to be 58.5% or above.

In the case of feeding the room air conditioner 10 with the cold water of 7° C., it is possible according to the invention to supply the cold water of 10° C. from the concentration difference regeneration device which can therefore employ even the concentrated heat accumulating liquid of a comparatively low concentration.

Figure 7:
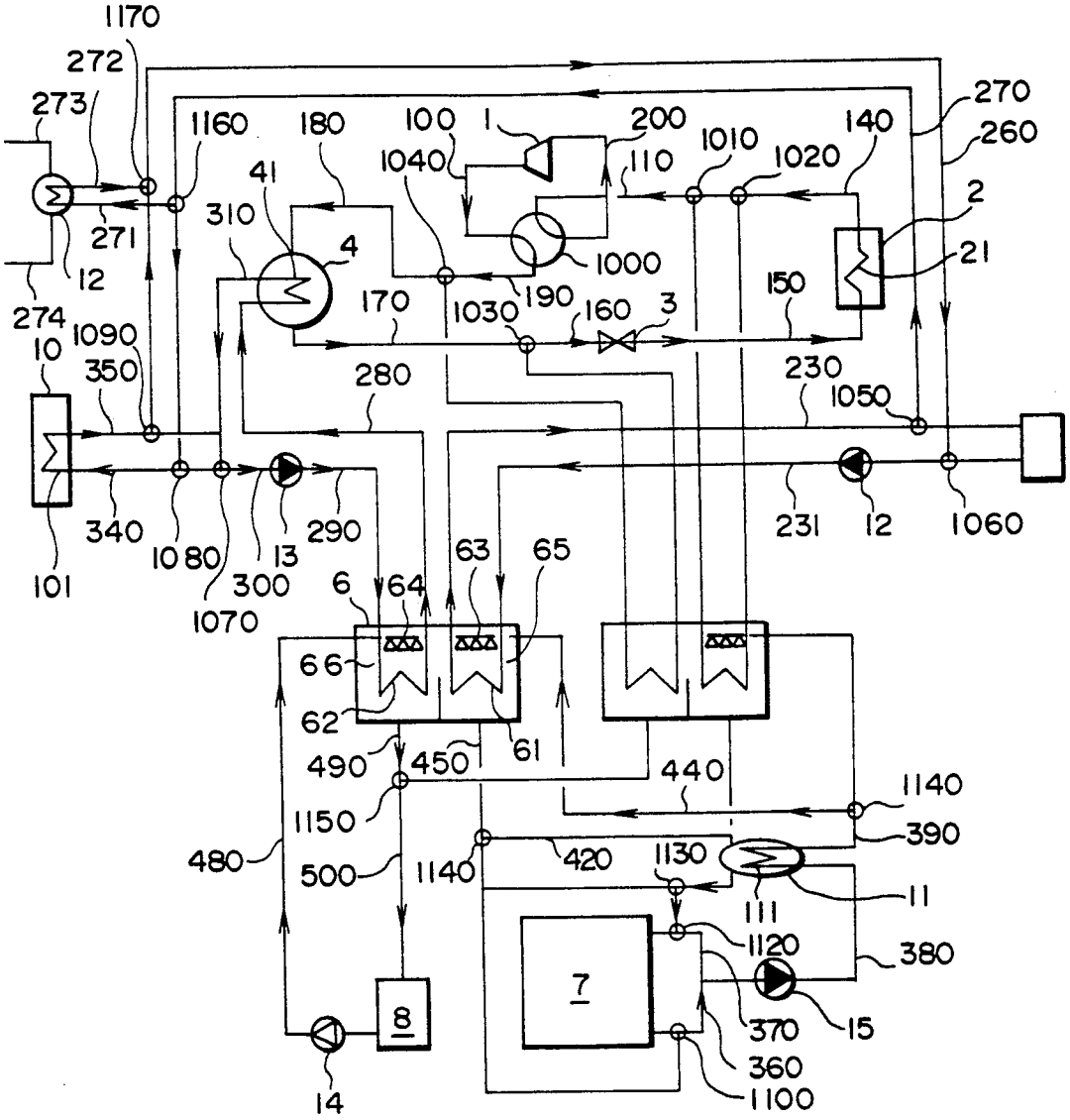
FIG. 7 is a schematic view of illustrating a heating and hot water supply operations of the regenerative type air conditioning equipment of the present invention.

In FIG. 7, numerals are affixed only to parts relevant to these operations in the regenerative type air conditioning equipment illustrated in FIG. 1.

The R-22 gas compressed by the compressor 1 into a high temperature and a high pressure has its flow altered by the four-way changeover valve 1000 into a direction different from the direction in the heat accumulating operation or the air cooling operation, and it is introduced into the first heat exchanger 4 via the piping 190, valve 1040 and piping 180. In the first heat exchanger 4, the R-22 gas, of high temperature and high pressure, is subjected to heat exchange with circulating water which flows inside the heat transmission pipe 41. The circulating water has its temperature raised, and is introduced into the diluting container 6 of the concentration difference regeneration device via the piping 310, valve 1070, piping 300, pump 13 and piping 290. On the other hand, the R-22 gas liquefies, whereupon, the resulting liquid reaches the expansion valve 3 via the piping 170, valve 1030 and piping 160 where it is adiabatically expanded. Thereafter, the liquid removes heat from the air and evaporates in the second heat exchanger 2. The resulting gas is introduced into the compressor 1 again via the piping 140, valve 1020, valve 1010, piping 110 and four-way changeover valve 1000.

While passing through the heat transmission pipe of the evaporator 62, the circulating water with a raised temperature introduced into the diluting container 6 has its temperature lowered by a heat exchange with condensed water which is sprayed outside this heat transmission pipe from the condensate liquid spray nozzle 64. The circulating water is then passed through the piping 280 and is sent to the first heat exchanger 4 again. On the other hand, the sprayed condensed water is heated to make it vaporize and moves toward the absorber 61. On this occasion, the condensate liquid is kept heated by the circulating water, so that it is vaporized even when the internal pressure of the diluting container 6 is comparatively high. Accordingly, the concentrated heat accumulating liquid of comparatively low concentration becomes usable for the same reason as in the air cooling operation.

Hot water is introduced from the room air conditioner 10 into the heat transmission pipe of the absorber 61 via the piping 350, the valve 1090, a valve 1170, piping 260, the valve 1060, the pump 12 and the piping 231. In addition, the outer side of the heat transmission pipe of the absorber 61 is sprayed with a concentrated heat accumulating liquid by the concentrated heat accumulating liquid spray nozzle 63. The concentrated heat accumulating liquid is simplified from the heat accumulating liquid reservoir 7 to the concentrated heat accumulating liquid spray nozzle 63 via the piping 360, pump 15, piping 380, heat recoverer 11, piping 440, etc. The sprayed concentrated heat accumulating liquid absorbs the vapor produced in the evaporator 62, thereby generating heat for heating the hot water inside the heat transmission pipe of the absorber 61. The hot water thus heated is introduced into the heat transmission pipe 101 of the room air conditioner 10 via the piping 230, the valve 1050, piping 270, a valve 1160, the valve 1080 and the piping 340.

In this manner, the concentration difference regeneration device is driven with the heat source of ambient temperature level obtained by the compression cycle, whereby hot water at a still higher temperature, specifically, at 80° C. or above can be produced.

Further, the hot water is caused to flow along piping 271, the heat transmission pipe of the heat exchanger for hot water supply 12, and piping 272 by switching the valves 1160 and 1170, and it heats water for hot water supply which is fed from piping 273 onto the outer side of the heat transmission pipe of the heat exchanger for hot water supply 12. Thus, hot water can be supplied from piping 274.

According to the embodiment described above, in the nighttime, the compression type heat pump device and the concentration difference regeneration device are driven to vaporize the concentrated liquid and to produce the condensate liquid and the concentrated heat accumulating liquid, which are stored. Then, in the daytime, air cooling and heating can be performed with the condensate liquid and the concentrated liquid. It is therefore possible to spread the day and night power loads.

Moreover, the concentrated heat accumulating liquid of high concentration can be produced in the heat accumulating operation, and even a concentrated heat accumulating liquid of comparatively low concentration can be used in the air cooling and heating operations. Therefore, the quantity of heat accumulating liquid to be reserved can be reduced, so that the size of the heat accumulating liquid reservoir 7, and, in turn, the size of the regenerative type air conditioning equipment can be reduced.

Further, according to the invention, the concentrating container 5 and diluting container 6 of the concentration difference regeneration device are formed as members separate from each other. Therefore, when the heat accumulating operation shifts to the air cooling operation or to the heating operation, heat loss due to the sensible heat changes of the constituents of each container attributed to the unequal temperature levels of the individual operations can be curtailed, and the length of the starting time can be shortened. Incidentally, the size of the concentration difference regeneration device is considerably governed by the size of the heat accumulating liquid reservoir 7, so that even when the separate formation enlarges the overall size of the concentrating container 5 and diluting container 6 of the concentration difference regeneration device, the reduction in the size of the heat accumulating liquid reservoir 7 can achieve a reduction in the size of the concentration difference regeneration device, consequently enabling reduction in the size of the regenerative type air conditioning equipment.

By virtue of the features of the present invention, since the available concentration range of a heat accumulating liquid can be widened, the quantity of the heat accumulating liquid to be reserved can be reduced, and the size of the regenerative type air conditioning equipment can also be reduced.

Moreover, since the concentrating container and diluting container of a concentration difference regeneration device are formed as separate containers, a heat loss due to the sensible heat changes of the constituents of each container attributed to the unequal temperature levels of individual operations can be curtailed, and the length of the starting time can be reduced.

What is claimed is:

1. A regenerative type air conditioning equipment having a compressor-type heat pump device which develops a low temperature through adiabatic expansion of a coolant, and a concentration difference regeneration device which at least cools a medium to be fed to an air conditioner, using a concentrated heat accumulating liquid after subjecting a heat accumulating liquid to evaporation, and a condensate liquid produced by condensing vapor obtained by evaporation of said heat accumulating liquid, wherein said concentration difference regeneration device includes an evaporator which vaporizes said condensate liquid under a low pressure, thereby removing heat from the medium sent from said air conditioner to cool said medium, and wherein said heat pump device includes a heat exchanger for subjecting said coolant cooled through said adiabatic expansion to heat exchange with said medium cooled by said evaporator to thereby further cool said medium and feed said cooled medium to said air conditioner.

2. A regenerative type air conditioning equipment having a compression-type heat pump device which develops a high temperature through adiabatic compression of a coolant; and a concentration difference regeneration device which raises a temperature of a medium to be fed to at least one of an air conditioner and a hot water supplier, using a concentrated heat accumulating liquid remaining after subjecting the heat accumulating liquid to evaporation, and a condensate liquid produced by condensing vapor obtained by said evaporation of said accumulating liquid wherein said concentration difference regeneration device includes:

an evaporator which directly or indirectly removes heat from the coolant having its temperature raised through adiabatic compression by said compression-type heat pump device, thereby heating and vaporizing said condensate liquid;

a spray nozzle for spraying the vaporized condensate liquid with said concentrated heat accumulating liquid; and an absorber for subjecting the concentrated heat accumulating liquid having generated heat through absorption of said vaporized condensate liquid, to a heat exchange with said medium to be fed to at least one of said air conditioner and said hot water supplier, thereby heating said medium.

3. A regenerative type air conditioning equipment having a compression-type heat pump device which develops a high temperature through adiabatic compression of a coolant and a low temperature through adiabatic expansion thereof; and a concentration difference regeneration device which cools a medium to be fed to an air conditioner and raises a temperature of said medium using a concentrated heat accumulating liquid remaining after subjecting the heat accumulating liquid to evaporation, and a condensate liquid produced by condensing vapor obtained by evaporation of said accumulating liquid, wherein said concentration difference regeneration device includes:

an evaporator operable in an air cooling mode by subjecting said medium send from said air conditioner to heat exchange with said condensate liquid thereby evaporating said condensate liquid, while cooling said medium, and which operates in a heating mode directly or indirectly to remove heat from the coolant having had its temperature raised through adiabatic compression by said compression-type heat pump device, thereby vaporizing said condensate liquid;

a spray nozzle which sprays the vaporized condensate liquid with said concentrated heat accumulating liquid; and an absorber which operates in said heating mode to subject the concentrated heat accumulating liquid having generated heat through absorption of said vaporized condensate liquid, to a heat exchange with said medium to be fed to said air conditioner, thereby heating said medium; and wherein said heat pump device includes a heat exchanger operable in said cooling mode to subject said coolant cooled through said adiabatic expansion to a heat exchange with said medium cooled by said evaporator thereby further cooling said medium, and which feeds the cooled medium to said air conditioner.

4. A regenerative type air conditioning equipment having a heat pump device which has a compressor for compressing a coolant, a first heat exchanger and a second heat exchanger for subjecting said coolant to heat exchanges, and an expander for adiabatically expanding said coolant, and a concentration difference regeneration device which, at least, cools a medium to be fed to an air conditioner, using a condensate liquid and a concentrated heat accumulating liquid that are produced by vaporizing the heat accumulating liquid, comprising the fact:

that said concentration difference regeneration device includes;

a container which has a condensate liquid chamber for storing said condensate liquid, and a concentrated heat accumulating liquid chamber for storing said concentrated heat accumulating liquid, and in which said chambers are held in communication with each other;

a condensate liquid spray nozzle which sprays said condensate liquid into said condensate liquid chamber;

a condensate liquid chamber heat exchanger which performs the heat exchange with heat generated in said condensate liquid chamber;

a concentrated heat accumulating liquid spray nozzle which sprays said concentrated heat accumulating liquid into said concentrated heat accumulating liquid chamber; and a concentrated heat accumulating liquid chamber heat exchanger which performs the heat exchange with heat generated in said concentrated heat accumulating liquid chamber; and that said heat pump device includes;

an air cooling mode coolant circulation line in which the coolant compressed by said compressor is circulated in the order of said second heat exchanger, said expander, said first heat exchanger, and said compressor; and an air cooling mode medium circulation line in which the medium passing through said air conditioner is circulated in the order of said condensate liquid chamber heat exchanger, said first heat exchanger, and said air conditioner.

5. A regenerative type air conditioning equipment as defined in claim 4, wherein said heat pump device includes a heat accumulating mode coolant circulation line in which said coolant compressed by said compressor is circulated in the order of said concentrated heat accumulating liquid chamber heat exchanger, said second heat exchanger, said expander, said condensate liquid chamber heat exchanger, and said compressor.

6. A regenerative type air conditioning equipment as defined in claim 4, wherein said container includes as separate members a diluting container in which said concentrated heat accumulating liquid is diluted by absorbing said condensate liquid, and a concentrating container in which said heat accumulating liquid is concentrated by vaporizing part thereof.

7. A regenerative type air conditioning equipment as defined in claim 4, wherein said concentration difference regeneration device includes;

a heat accumulating liquid reservoir which stores said heat accumulating liquid, and which is provided with an upper nozzle and a lower nozzle that are capable of putting in and taking out said heat accumulating liquid;

a heat accumulating liquid return line which returns said heat accumulating liquid from said concentrated heat accumulating liquid chamber to said heat accumulating liquid reservoir;

a heat accumulating liquid feed line which feeds said heat accumulating liquid from said heat accumulating liquid reservoir to said concentrated heat accumulating liquid spray nozzle;

upper nozzle connection tip changeover means for switching a connection tip of said upper nozzle between said heat accumulating liquid return line and said heat accumulating liquid feed line; and lower nozzle connection tip changeover means for switching a connection tip of said lower nozzle between said heat accumulating liquid return line and said heat accumulating liquid feed line.

8. A regenerative type air conditioning equipment having a heat pump device which has a compressor for compressing a coolant, a first heat exchanger and a second heat exchanger for subjecting said coolant to heat exchanges, and an expander for adiabatically expanding said coolant, and a concentration difference regeneration device which raises a temperature of a medium to be fed to at least one of an air conditioner and a hot water supplier, using a condensate liquid and a concentrated heat accumulating liquid that are produced by vaporizing the heat accumulating liquid, comprising the fact:

that said concentration difference regeneration device includes;

a container which has a condensate liquid chamber for storing said condensate liquid, and a concentrated heat accumulating liquid chamber for storing said concentrated heat accumulating liquid, and in which said chambers are held in communication with each other;

a condensate liquid spray nozzle which sprays said condensate liquid into said condensate liquid chamber;

a condensate liquid chamber heat exchanger which performs the heat exchange with heat generated in said condensate liquid chamber;

a concentrated heat accumulating liquid spray nozzle which sprays said concentrated heat accumulating liquid into said concentrated heat accumulating liquid chamber; and a concentrated heat accumulating liquid chamber heat exchanger which performs the heat exchange with heat generated in said concentrated heat accumulating liquid chamber; and that said heat pump device includes;

a heating mode coolant circulation line in which the coolant compressed by said compressor is circulated in order of said first heat exchanger, said expander, said second heat exchanger, and said compressor;

a heating mode hot medium circulation line in which the hot medium passing through said first heat exchanger is circulated between said first heat exchanger and said condensate liquid chamber heat exchanger; and a heating mode medium circulation line in which said medium is circulated between said air conditioner or said hot water supplier and said concentrated heat accumulating liquid chamber heat exchanger.

9. A regenerative type air conditioning equipment as defined in claim 8, wherein said heat pump device includes a heat accumulating mode coolant circulation line in which said coolant compressed by said compressor is circulated in the order of said concentrated heat accumulating liquid chamber heat exchanger, said second heat exchanger, said expander, said condensate liquid chamber heat exchanger, and said compressor.

10. A regenerative type air conditioning equipment as defined in claim 8, wherein said container includes as separate members a diluting container in which said concentrated heat accumulating liquid is diluted by absorbing said condensate liquid, and a concentrating container in which said heat accumulating liquid is concentrated by vaporizing part thereof.

11. A regenerative type air conditioning equipment as defined in claim 8, wherein said concentration difference regeneration device includes:

a heat accumulating liquid reservoir which stores said heat accumulating liquid, and which is provided with an upper nozzle and a lower nozzle that are capable of putting in and taking out said heat accumulating liquid;

a heat accumulating liquid return line which returns said heat accumulating liquid from said concentrated heat accumulating liquid chamber to said heat accumulating liquid reservoir;

a heat accumulating liquid feed line which feeds said heat accumulating liquid from said heat accumulating liquid reservoir to said concentrated heat accumulating liquid spray nozzle;

upper nozzle connection tip changeover means for switching a connection tip of said upper nozzle between said heat accumulating liquid return line and said heat accumulating liquid feed line; and lower nozzle connection tip changeover means for switching a connection tip of said lower nozzle between said heat accumulating liquid return line and said heat accumulating liquid feed line.

12. A regenerative type air conditioning equipment having a heat pump device which has a compressor for compressing a coolant, a first heat exchanger and a second heat exchanger for subjecting said coolant to heat exchanges, and an expander for adiabatically expanding said coolant, and a concentration difference regeneration device which cools a medium to be fed to an air conditioner and raises a temperature thereof, using a condensate liquid and a concentrated heat accumulating liquid that are produced by vaporizing the heat accumulating liquid, comprising the fact:

that said concentration difference regeneration device includes as separate members a concentrating container in which said heat accumulating liquid is concentrated by vaporizing part thereof, and a diluting container in which said concentrated heat accumulating liquid is diluted by absorbing said condensate liquid;

that each of said concentrating container and said diluting container includes a condensate liquid chamber for storing said condensate liquid, and a concentrated heat accumulating liquid chamber for storing said concentrated heat accumulating liquid, said chambers being held in communication with each other;

that said concentrating container includes a heat accumulating liquid spray nozzle which sprays said heat accumulating liquid into said concentrated heat accumulating liquid chamber, a concentrated heat accumulating liquid chamber heat exchanger which performs the heat exchange with heat generated in said concentrated heat accumulating liquid chamber, and a condensate liquid chamber heat exchanger which performs the heat exchange with heat generated in said condensate liquid chamber;

that said diluting container includes a condensate liquid spray nozzle which sprays said condensate liquid into said condensate liquid chamber, a condensate liquid chamber heat exchanger which performs the heat exchange with heat generated in said condensate liquid chamber, a concentrated heat accumulating liquid spray nozzle which sprays said concentrated heat accumulating liquid into said concentrated heat accumulating liquid chamber, and a concentrated heat accumulating liquid chamber heat exchanger which performs the heat exchange with heat generated in said concentrated heat accumulating liquid chamber; and that said heat pump device includes;

a heat accumulating mode coolant circulation line in which the coolant compressed by said compressor is circulated in the order of said concentrated heat accumulating liquid chamber heat exchanger of said concentrating container, said second heat exchanger, said expander, said condensate liquid chamber heat exchanger of said concentrating container, and said compressor;

an air cooling mode coolant circulation line in which said coolant compressed by said compressor is circulated in the order of said second heat exchanger, said expander, said first heat exchanger, and said compressor;

an air cooling mode medium circulation line in which the medium passing through said air conditioner is circulated in order of said condensate liquid chamber heat exchanger of said diluting container, said first heat exchanger, and said air conditioner;

a heating mode coolant circulation line in which said coolant compressed by said compressor is circulated in order of said first heat exchanger, said expander, said second heat exchanger, and said compressor;

a heating mode hot medium circulation line in which the hot medium passing through said first heat exchanger is circulated between said first heat exchanger and said condensate liquid chamber heat exchanger of said diluting container; and a heating mode medium circulation line in which said medium is circulated between said air conditioner and said concentrated heat accumulating liquid chamber heat exchanger of said diluting container.

13. A regenerative type air conditioning equipment as defined in claim 12, wherein said concentration difference regeneration device includes;

a heat accumulating liquid reservoir which stores said heat accumulating liquid, and which is provided with an upper nozzle and a lower nozzle that are capable of putting in and taking out said heat accumulating liquid;

a heat accumulating liquid return line which returns said heat accumulating liquid from said concentrated heat accumulating liquid chamber to said heat accumulating liquid reservoir;

a heat accumulating liquid feed line which feeds said heat accumulating liquid from said heat accumulating liquid reservoir to said concentrated heat accumulating liquid spray nozzle;

upper nozzle connection tip changeover means for switching a connection tip of said upper nozzle between said heat accumulating liquid return line and said heat accumulating liquid feed line; and lower nozzle connection tip changeover means for switching a connection tip of said lower nozzle between said heat accumulating liquid return line and said heat accumulating liquid feed line.

* * * * *